US005095559A

United States Patent [19]

Liljegren et al.

[11] Patent Number: 5,095,559

[45] Date of Patent: Mar. 17, 1992

[54] HEATING APPARATUS

[75] Inventors: Leif Liljegren, Oakland, N.J.; Harry J. Scanlan, Edinburg, Va.

[73] Assignee: South Breeze Corporation, Edinburg, Va.

[21] Appl. No.: 537,337

[22] Filed: Jun. 13, 1990

[51] Int. Cl.[5] ..... A61H 33/02; H05B 1/00

[52] U.S. Cl. ..... 4/542; 4/559; 392/354; 392/373; 392/482; 392/485; 392/489; 219/201; 219/217; 441/130

[58] Field of Search ..... 4/541, 543, 542, 544, 4/559; 392/354, 353, 355, 356, 357, 358, 373, 380, 383, 495, 489, 485, 482; 219/201, 217, 528; 128/33, 66; 441/129, 130; 5/423; 297/180; 261/DIG. 31, 32

[56] References Cited

U.S. PATENT DOCUMENTS

| | | | |
|---|---|---|---|
| 377,394 | 2/1888 | Knaak | 4/543 |
| 1,082,168 | 12/1913 | Philp et al. | 392/482 |
| 1,350,974 | 8/1920 | Kolshorn | 4/543 |
| 1,409,019 | 3/1922 | Parnell-Smith | 392/489 |
| 1,926,958 | 9/1933 | Peterson | 392/481 X |
| 2,493,067 | 1/1950 | Goldsmith | 219/528 X |
| 2,512,559 | 6/1950 | Williams | 392/354 X |
| 2,979,311 | 4/1961 | Bungas | 392/358 X |
| 3,065,746 | 11/1962 | Gregory | 128/66 |
| 3,075,520 | 1/1963 | Sparks | 128/66 |
| 3,111,686 | 11/1963 | Sierant | 4/543 |
| 3,138,153 | 6/1964 | Osborn et al. | 128/66 |
| 3,444,922 | 5/1969 | Dingman | 219/217 X |
| 3,710,786 | 1/1973 | Rico et al. | 4/559 X |
| 3,772,714 | 11/1973 | Sealby et al. | 4/541 |
| 3,809,073 | 5/1974 | Baumann | 4/542 X |
| 3,836,750 | 9/1974 | Caruso | 392/383 X |
| 4,000,528 | 1/1977 | Posnick | 4/584 |
| 4,008,498 | 2/1977 | Thomas | 4/543 |
| 4,040,415 | 8/1977 | Kulisch | 128/66 |
| 4,245,625 | 1/1981 | Murray | 128/66 |
| 4,249,522 | 2/1981 | Carrier | 128/66 |
| 4,417,568 | 11/1983 | Nozawa et al. | 128/33 |
| 4,521,674 | 6/1985 | Scanlan et al. | 392/492 |
| 4,535,490 | 8/1985 | Wright | 4/585 |
| 4,747,447 | 5/1988 | Scanlan et al. | 165/104.34 |
| 4,962,759 | 10/1990 | Stern et al. | 4/544 X |
| 4,984,583 | 1/1991 | Peterson et al. | 4/542 X |
| 4,986,781 | 1/1991 | Smith | 4/542 X |

*Primary Examiner*—Henry J. Recla
*Assistant Examiner*—Glenn T. Barrett
*Attorney, Agent, or Firm*—Brumbaugh, Graves, Donohue & Raymond

[57] ABSTRACT

A heating apparatus comprises a closed vessel having thermally conducting walls and containing a gas that is heated by one or more electrical heating elements in the vessel. The vessel is received in a duct through which air is blown. The air is heated by the heat transferred to the vessel walls by the gas in the vessel. Pressure and thermostatic switches in the circuit of the heating element communicate with the gas in the vessel and provide a double-safety, over-temperature power shut-off. The heating apparatus may be used to blow hot air into water in a tub through hoses leading to inlet openings or to an air distribution mat placed in the tub. The bubbles of hot air heat the water and produce strong agitation. A special raft receives the air distribution mat, which heats water in the raft by bubbling hot air through it. The heating apparatus can also be used for space heating, warming and drying towels and clothes, hair drying and grooming animals.

31 Claims, 7 Drawing Sheets

HEATING APPARATUS

FIELD OF THE INVENTION

The present invention relates to heating apparatus and, in particular, to an electrical heating apparatus for heating air for such uses as maintaining or increasing the temperature of the water in a tub, spa, or small pool or a raft floating in a pool, pond or stream, for space heating, for warming and/or drying towels and other articles, for hair drying and for drying animals. When the apparatus is used to heat water, a pleasurable bubbling of the water is produced.

BACKGROUND OF THE INVENTION

In a variety of forms warmth is relaxing and pleasurable to most people—basking in the sun; sitting by an open fire or a woodstove; reclining in a hot bath, whirlpool or spa; dressing in a warm room; a warm, dry towel after a shower or bath—all of these experiences are enjoyable. Many of them require some form of heating device, and heating devices of many types are widely available to fulfill the requirements. In some cases, however, the available heating devices have significant disadvantages.

For example, the water for bathtubs, spas, hot tubs, whirlpools and the like is almost always heated by a water heater. In most installations the water in those vessels cannot be recirculated through the water heater, so the only way to maintain or increase the water temperature is to add more hot water, perhaps releasing some of the cooled water to make room for the added hot water. For another example, keeping an entire apartment or house warm in cold weather is expensive. Therefore, it is desirable from an economic point of view to use a space heater, preferably on a periodic basis, to warm up a room, commonly a bathroom, for dressing. Many of the available types of space heaters can be dangerous if not used with care. The main hazard is fire, which can result from a towel or clothing dropping onto the heater or placing the heater too close to a flammable object.

An example of an extremely costly and wasteful use of heat for comfort and pleasure is a heated swimming pool or hot tub. The installation for heating swimming pools and hot tubs costs several thousands of dollars, and many hundreds of dollars have to be spent for fuel each year.

It is known, per se, to maintain or increase the temperature of the water in a bathtub and at the same time provide a whirlpool effect by bubbling heated air into the water. Examples of devices for this purpose are found in U.S. Pat. Nos. 1,350,974 (Kolshorn, Aug. 24, 1920); 3,065,746 (Gregory, Nov. 27, 1962); 3,075,520 (Sparks, Jan. 29, 1963); 3,111,686 (Sierant, Nov. 26, 1963); 3,138,153 (Osborn et al., June 23, 1964); 4,040,415 (Kulisch, Aug. 9, 1977); 4,245,625 (Murray, Jan. 20, 1981); and 4,535,490 (Wright, Aug. 20, 1985). To the extent that those patents describe specific heating devices, all of them use electrical heating elements that are in direct heat transfer contact with the air flow that is delivered by them. None of the devices of those patents provides protection against fire due to overheating of the heating element.

Safety against an electrical shock of any electrical appliance used near water is of paramount concern. The prior art tub-heating devices appear by and large to have ignored the shock hazard, which can result from water backing up in the air supply pipe into the heating unit or from accidental immersion of the unit. An exception is the tub massage apparatus described and shown in U.S. Pat. No. 4,040,415 (Kulisch, Aug. 9, 1977), in which a blower/heater unit operating on no more than 24 volts is powered by line current through a power pack (transformer) located remotely from the tub. The patents referred to above disclose a variety of forms of devices for injecting air bubbles into the tub, the most common one being a tube positioned around the perimeter of the tub bottom. Perimeter tubes are cumbersome to install, remove and store and release the air bubbles primarily at the sides of the person's body, not under the body. Another form is a pad or mat of the type shown in U.S. Pat. No. 4,417,568 (Nozawa et al., Nov. 29, 1983), which has the advantage of being foldable but the disadvantage of being hard and, therefore, uncomfortable. U.S. Pat. No. 4,008,498 (referred to above) proposes a water-filled compartmented mat (like a water bed) with air tubes extending lengthwise along it.

In temperate climates, such as most of the continental United States, there are times of the year when swimming pools are not environmentally heated enough to be usable, but days pleasant enough to make use of a swimming pool are abundant. As far as the present inventors are aware, there are no devices available for making swimming pools comfortably useful other than costly pool water heaters.

SUMMARY OF THE INVENTION

One object of the present invention is to provide a relatively inexpensive heating device that can be used for such purposes as keeping the water in a tub, spa or hot tub warm, for space heating, for drying towels and garments, for hair drying and for animal grooming. Another object is to provide a heating device that is doubly protected against overheating. Still a further object is to provide an air distribution pad that is comfortable to sit or lie on, easy to use and store, and is thermally insulating. An additional object is to provide a raft-like vessel that a person can lie on in a pool, pond or stream immersed in water agitated and heated by air from the heating device.

The foregoing and other objects are achieved, according to the present invention, by heating apparatus that comprises a closed vessel having thermally conducting walls and containing a gas. An electrical heating element within the vessel is adapted to be connected to a source of electrical current to form an electrical circuit with the heating element. A pressure-responsive electrical switch communicates with the gas in the vessel and is connected in the heating element circuit such as to open the circuit in response to a predetermined pressure of the gas in the vessel and a temperature-responsive electrical switch senses the temperature of the gas in the vessel and is connected in the heating element circuit such as to open the circuit in response to a predetermined temperature of the gas in the vessel. A duct surrounds the vessel and defines with the vessel walls an air flow passage. A blower causes ambient air to flow through the air flow passage so as to be heated by the vessel walls.

In preferred embodiments of the heating apparatus, a pressure relief valve is connected to the vessel for releasing the gas from the vessel in response to a predetermined pressure, which is an additional safety feature for preventing the vessel from bursting. The apparatus further comprises a housing having oppositely located side walls, one of which has a hot air outlet in communication with the duct and a hose coupling mounted in the outlet and adapted to be connected to a hose, whereby heated air may be conducted to a location remote from the duct.

The sensing electrodes of a ground fault interrupt circuit are located on the housing for opening the electrical circuit in the event that the housing is immersed in water such as to form an electrically conductive path between the sensing electrodes.

Preferably, the housing has top, bottom, front and rear walls, all of which extend between the side walls, and the duct extends between the side walls, is located adjacent the rear wall, and is supported in the housing in spaced-apart relation to the top and bottom walls. The blower is located within the housing on the opposite side of the duct from the rear wall and has its intake within the housing. The rear wall has inlet openings for admitting air to the housing, whereby ambient air is inducted into the housing through the inlet openings, flows over the outer surface of the duct, and extracts heat from the duct, thereby keeping the housing walls relatively cool and preheating the inducted air The vessel has a circular cylindrical peripheral wall from which a multiplicity of external ribs project radially and extend axially. The duct is a circular cylindrical tube, and the extremities of the ribs engage the inner surface of the duct, whereby the ribs both support the vessel in the duct and transfer heat to the air flowing through the passage.

As an optional but desirable feature, the duct communicates at its hot air discharge end with two hot air outlets on the housing, one of which outlets includes a hose coupling adapted to receive a hose for conducting hot air to a location remote from the housing, and the other of which leads to a distributor pipe adapted to discharge hot air to the environment of the housing. The distributor pipe is fixed to the housing and has at least one outlet slot opening in a direction away from the interior of the housing. A discharge control tube is received telescopically over the distributor pipe for movement relative thereto, the control tube having at least one outlet passage located for registration with the outlet slot of the distributor pipe in at least one first position of the control tube relative to the distributor pipe and for non-registration with the distributor pipe in a second position of the control tube relative to the distributor pipe. The control tube may be rotatably mounted on the distributor tube and the first and second positions of the outlet passage are circumferentially spaced apart relative to the distributor pipe. A flapper valve is provided for selectively opening and closing the outlet to the hose, and a linkage between the flapper valve and the control tube automatically closes the hose outlet when the control tube is in its open position and opens the hose outlet when the control tube is in its closed position. The control tube is operated by a handle attached to it, which may also serve as a carrying handle for the apparatus. A separate carrying handle can be provided.

According to another aspect of the present invention, there is provided a hot air distribution pad adapted to be submerged in a body of water contained in a tub, spa, pool or the like and to be sat or lain upon by a person. The pad includes at least two elongated chambers defined by air-impermeable flexible webs, each chamber communicating with an air inlet to which a hose can be connected and having a multiplicity of outlet orifices for releasing hot air into the water. The pad is weighted to an extent that it remains submerged when hot air is conducted into it. In preferred forms the pad includes a pair of flexible webs joined to each other such as to form a multiplicity of compartments, and each compartment contains a quantity of a granular material having a density substantially greater than that of water. There are three elongated air distribution chambers disposed laterally adjacent each other and having lengths such as to extend from the lower thighs to the shoulders of a person, the outer two chambers being divergent with respect to each other from a thigh end to a shoulder end and each chamber having a multiplicity of longitudinally spaced apart air outlet orifices. The outlet orifices of the two outer chambers are staggered lengthwise relative to the outlet orifices of the center chamber. Preferably, the outlet chambers are defined by first and second webs of air-impermeable flexible material, such as a coated fabric.

According to yet another aspect of the invention, there is provided a floatable raft that is specially designed to receive the hot air distribution pad. The raft includes a peripheral air-inflatable floatation chamber formed by air-impermeable flexible members. Preferably, the raft includes a pair of air-impermeable flexible webs joined to each other to form the air-inflatable floatation chamber along their perimeters and a raft bottom upon which the pad rests and by which it is supported. The floatation chamber has an air inlet in communication with a hot air supply hose from the heating apparatus, whereby the floatation chamber is inflated by the hot air conducted through the hose. The raft bottom includes compartments, each of which contains a polymeric foam sheet that provides bouyancy to the raft such as to keep it and the pad afloat, even when the floatation chamber is not inflated. The raft bottom may also include a bottom air-inflatable floatation chamber positioned to underlie a portion of the pad and lateral air-inflatable floatation chambers extending generally laterally between the bottom chamber and the peripheral chamber. The pad is preferably detachably fastened to the raft bottom.

One important advantage of heating apparatus embodying the present invention over prior art devices is a greater level of protection against overheating. Both a temperature-responsive switch and a pressure-responsive switch are provided in the power circuit for the heating element to shut off power to the heating element if it should overheat. Should one of the two switches fail to operate properly, the other should almost certainly function—the chance of both switches failing is much less than that of either one becoming inoperative. Moreover, an overheated condition is detected in a well-defined environment at the heat source, namely, a quantity of confined gas heated by the heating element.

Another aspect of the safety of the apparatus is the fact that the heating element is enclosed within a chamber that is received within a duct which in turn is enclosed in a housing. The heat from the heating element is spread over the relatively large surface of the chamber walls, which remain relatively cool as compared with the heating elements in the chamber. The air flow through the duct keeps the duct walls even cooler than the vessel walls, and the duct is also cooled by air inducted into the housing. Accordingly, the housing remains cool and prevents no danger of burning someone who touches it or of igniting something that touches it or is close by. The heating elements are also protected by the chamber against contact with water. If the proper flow of air through the apparatus is interrupted, the reduction of the rate of heat transfer from the chamber walls will cause the temperature and pressure of the gas in the chamber to increase long before the temperatures of the duct and housing increase appreciably, and current flow to the heating elements will be shut off at an early stage of overheating.

The apparatus presents virtually no electrical shock hazard. The heating elements are encased in a ceramic within tubes, which, in turn, are contained in the closed chamber. The heating elements are also mounted in a cap on the chamber that is electrically isolated from the rest of the apparatus by a rubber sleeve. When used to heat water by bubbling air through it, the apparatus is located remotely from the water and is connected by a plastic (electrically non-conducting) tube to the hot air outlet. The ground fault interrupt device instantly shuts off all power to the apparatus when the sensing electrode contacts water, so if the apparatus enters the water, it is de-energized and poses no threat to someone who attempts to retrieve it or to persons in the water.

Another advantage of the invention is versatility of use. The heating apparatus can be used with air-distribution devices of various forms, such as a pad or one or more distribution pipes immersed in a tub or pool, connected to one or more inlets into a tub, spa, or whirlpool bath, or a nozzle connected to a hose (e.g., for hair-drying or grooming animals), or a nozzle or duct leading to the ambient air for space-heating or drying towels and garments.

When the heating apparatus is used with a submerged distribution pad, the pad of the present invention is advantageously employed. It is flexible, so it will conform to tubs and the like of various shapes. Also it is relatively soft and, therefore, more comfortable to lie or sit on than the hard plastic pads in widespread use. Also, it can be rolled up for case of storage.

The special raft, according to the invention, provides a whole new field of use for hot air generating apparatus. The raft can be used in any protected body of water at times when the water itself is uncomfortable. Water filling the raft is preheated with the heating apparatus to make it comfortable, and the user can lie on the pad and relax in the bubbling warm water emanating from it. The raft and pad can also be used without the heating apparatus when the water in which the raft is used is comfortable.

For a better understanding of the invention reference may be made to the following description of an exemplary embodiment, taken in conjunction with the accompanying drawings.

DESCRIPTION OF THE EMBODIMENT

Figure 1:
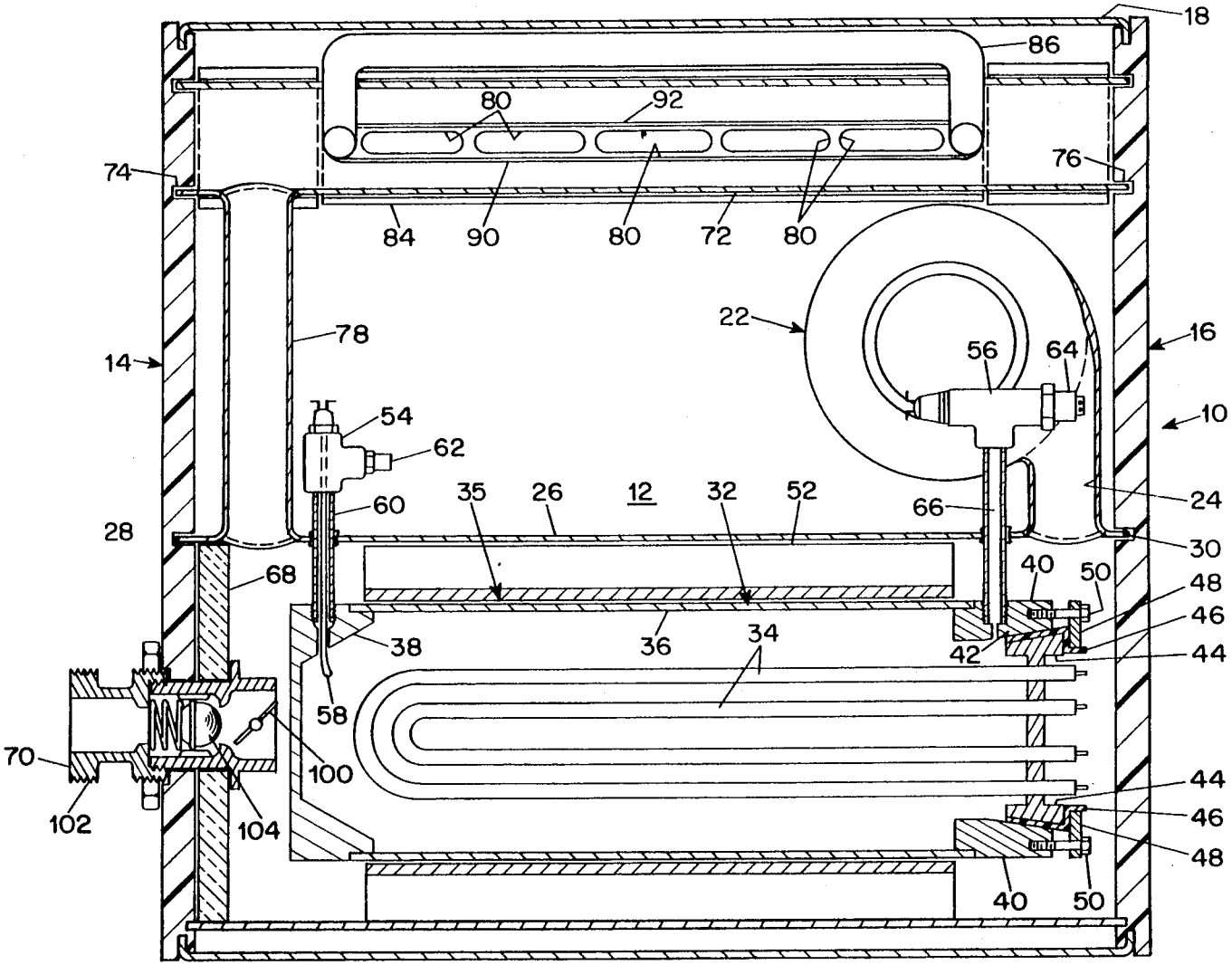
FIG. 1 is a top cross-sectional view of an embodiment of heating apparatus according to the invention.
Figure 2:
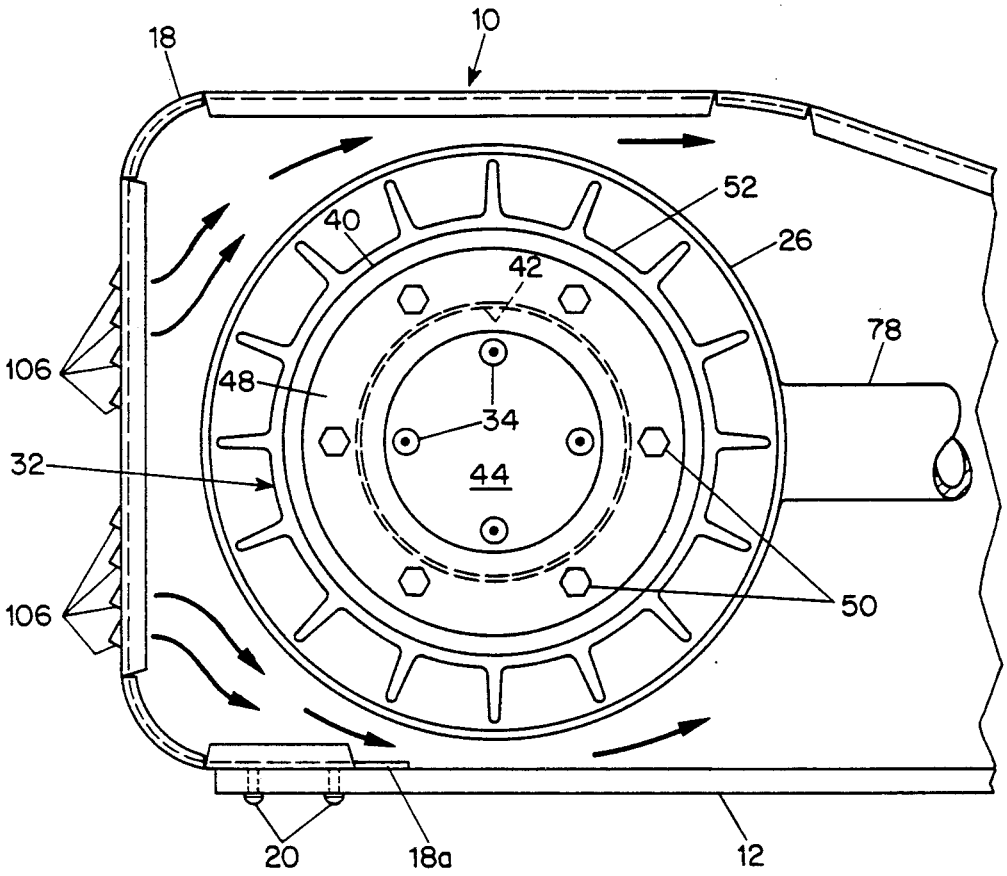
FIG. 2 is a partial side elevational view of the heating apparatus of FIG. 1, with the near side wall of the casing removed.
Figure 3:
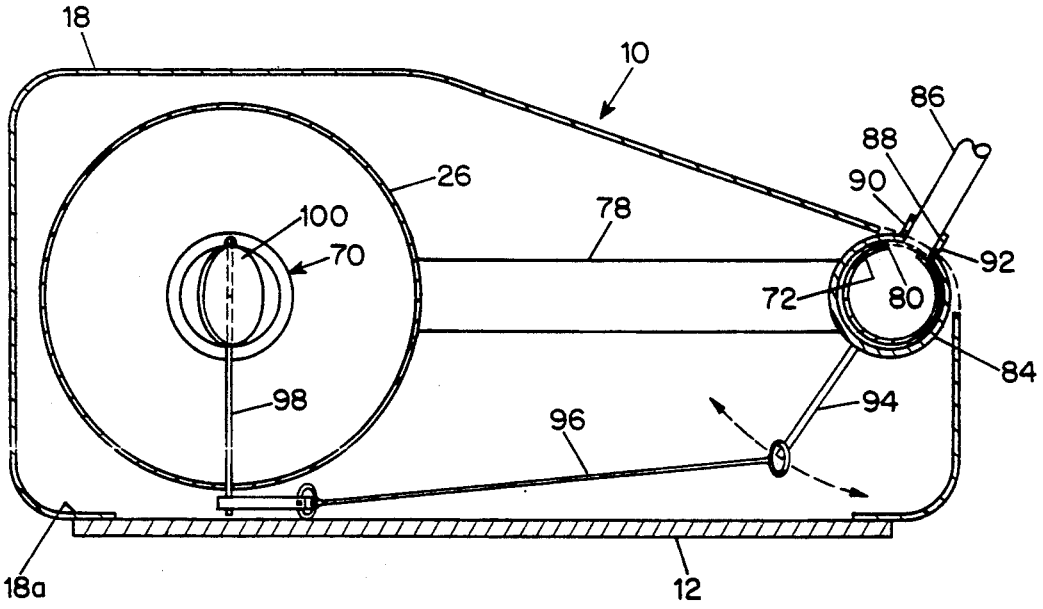
FIG. 3 is an end cross-sectional view taken generally along the line 3—3 of FIG. 1.
Figure 4:
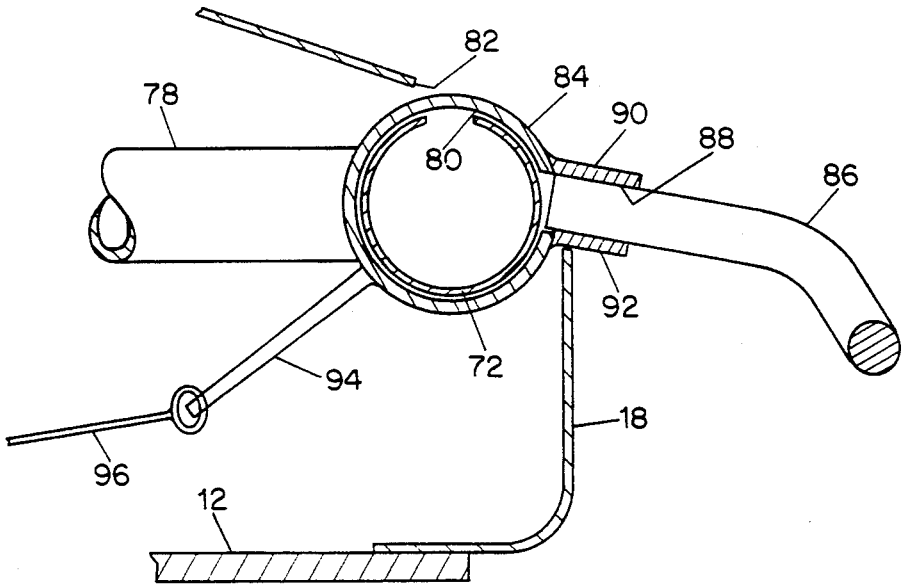
FIG. 4 is a detail sectional view of the distribution tube and valve of the embodiment in the closed configuration.

The heating apparatus of FIGS. 1 to 5 comprises a housing 10 having a flat metal base plate 12, a pair of side wall plates 14 and 16 securely fastened upright to the respective opposite sides of the base plate 12 and a sheet metal cover 18 that wraps around the top, front and rear of the housing and is fastened along inturned ends (e.g., 18*a*) to the base plate 12 by screws 20. Each side wall plate 14 and 16 has a groove along its front, rear and top edges that receives edge flanges bent at right angles inwardly from each side of the cover 18. The side wall plates 14 and 16 are, preferably, made from a durable, heat-resistant, electrically insulating material, such as phenolic. The cover 18 may be made of stainless steel sheet for durability and good appearance.

An electric motor-driven centrifugal fan 22 is mounted on the base plate 12 and delivers air through a discharge duct 24 into a heating chamber defined by a tube 26. The tube is mounted in the side wall plates 14 and 16 by reception of its ends in circular grooves 28 and 30 formed in the wall plates. The heating chamber tube 26 receives an electrical heating unit 32 that consists of electrical resistance heating elements 34 contained in a closed vessel 35. The vessel is defined by a circular cylindrical peripheral wall 36, an end wall 38 and an end fitting 40 having a conical hole 42. The heating elements, which are commercially available, consist of resistance wire encased in a ceramic insulator and sheathed in stainless steel tubes and are silver-soldered in holes in a cap 44 that fits in the hole 42. A rubber seal 46 is interposed between the cap 44 and the fitting 40 and also between a clamp ring 48 and the cap. The clamp ring 48 is fastened to the fitting 40 by machine screws 50, which are tightened to securely fasten the cap and heating elements to the vessel and to form a hermetic seal.

The vessel contains a gas, such as air, nitrogen, or helium. As proposed in U.S. Pat. Nos. 4,521,674 (Scanlan et al., June 4, 1985) and 4,747,447 (Scanlan et al., May 31, 1988), the gas is, preferably, under superatmospheric pressure, as initially filled at an ambient temperature of 20° C., in order to increase the rate of transfer of heat from the heating elements to the walls of the vessel. A desirable range of pressures is from about 200 kPa to about 700 kPa (absolute pressures in kilopascals).

The heating unit 32 has several advantages. For one thing, the intense heat of the heating elements 32 is distributed and spread by heat transfer through the gas in the vessel over the comparatively much larger area of the vessel walls, thus providing a large heat transfer surface (the vessel walls) for transfer to air blown through the heating chamber by the fan 22. The heat transfer area is further increased by a finned sleeve 52 received over the wall 36 of the vessel 32. Second, the heating elements are enclosed and protected by the vessel, and the vessel, in turn, provides a barrier (in addition to the housing) to isolate electrically and thermally the heating elements from the environment, thus reducing the electrical shock hazard should an element short and the fire hazard otherwise presented by exposed heating elements; the vessel walls are at a relatively low temperature, as compared with the heating elements. Third, the closed, gas-containing vessel provides a way of doubly protecting the heating apparatus against overheating, namely by a thermostatic switch 54 and a pressure switch 56 wired in a circuit (described below) with the heating elements 34 so as to deenergize them in response to either a rise in temperature or the corresponding rise in the pressure of the gas in the vessel 32 above predetermined levels. The sensor 58 of the thermostatic switch 54 extends through a tube 60 into the closed chamber defined by the vessel 34. The thermostatic switch 54 is also integrated with a fitting and check valve 62 by which the vessel is filled with the gas. The pressure switch 56 is integrated with a pressure relief valve 64, which is also a safety feature of the device, in that it releases the gas from the vessel in the event of extreme overheating that might cause the vessel to burst, an event that is extremely unlikely in view of the double-safety thermostatic- and pressure-responsive shut-offs of the heating unit. The pressure switch 56 and pressure relief valve 64 communicate with the vessel through a tube 66.

Heat is transferred from the heating unit 32 to the air blown by the fan 22 through the annular space between the heating unit 34 and the tube 26. Thermal insulation 68 at the downstream end of the tube 26 keeps the hot air from excessively heating the side wall 14 of the housing. The heated air is discharged from the apparatus through either an outlet fitting 70 installed in the side wall 14 of the housing or an outlet tube 72 that is mounted by reception of its ends in circular grooves 74 and 76 in the side walls 14 and 16 and is connected to the tube 26 by a branch duct 78. The outlet tube 72 has a row of longitudinally elongated outlet holes 80 that face upwardly through an opening 82 in the housing cover 18 and is surrounded by a control tube 84 that fits closely to it but is rotatable by a handle 86 between a position in which an air discharge slot 88 defined by plates 90 and 92 registers with the holes 80 (FIG. 3) and a position in which the holes 80 are covered by the control tube 84. The control tube 84 is coupled by an arm 94 and a link 96 to a control arm 98 on a flapper valve 100 mounted in the outlet fitting 70 in such a way that when the outlet holes 80 in the tube 72 are closed (FIG. 4), the flapper valve 100 is open, and vice versa. Accordingly, the user, by moving the handle 86 to change the position of the tube 84, can control the apparatus to discharge hot air from either the tube 72 into the room for space heating or drying towels or clothing hung above the apparatus or to discharge it through the outlet fitting 70 for delivery through a hose. For the latter purpose, the fitting 70 has a threaded coupling portion 102 that receives a mating coupling on the hose and a lightly spring-loaded, one-way ball check valve 104 for preventing water in the hose from entering the apparatus should the hose be picked up and elevated above the apparatus while it has some water in it.

The housing is, preferably, designed to be fairly air tight except for small vent holes (not shown) in the bottom plate to admit air for cooling the fan motor and for louvers 106 (FIG. 2) in the rear portion of the cover 18 for admitting the major part of the outside air that will be inducted by the fan 22 for delivery to the heating unit. In order to reach the fan intake, the air entering through the louvers has to flow over the top and bottom portions of the tube 26 and in so doing keeps the tube cool and is itself preheated.

The electrical circuitry (FIG. 5) for the heating apparatus is designed to minimize the hazards of electrical shock and fire. All wiring connections (not shown) are mechanically waterproofed by jackets so that if water intrudes, it is inhibited from grounding the wiring. A ground fault interrupt type cordset 110 is used to connect the apparatus to an electrical receptacle. The interrupt circuit is located in the plug, and the electrodes **110*a* are connected to it by conductors 111 and are mounted on an electrical board 112 so as to be exposed (but preferably also recessed) externally in order to deenergize the apparatus instantly in the event that it is accidentally immersed. The board 112 is mounted on the base 12 of the housing 10, and the electrodes 110*a* and a power switch 114 are mounted on a flange 112*a* of the board that is exposed through a window 114 in the housing side wall 14**.

Figure 5:
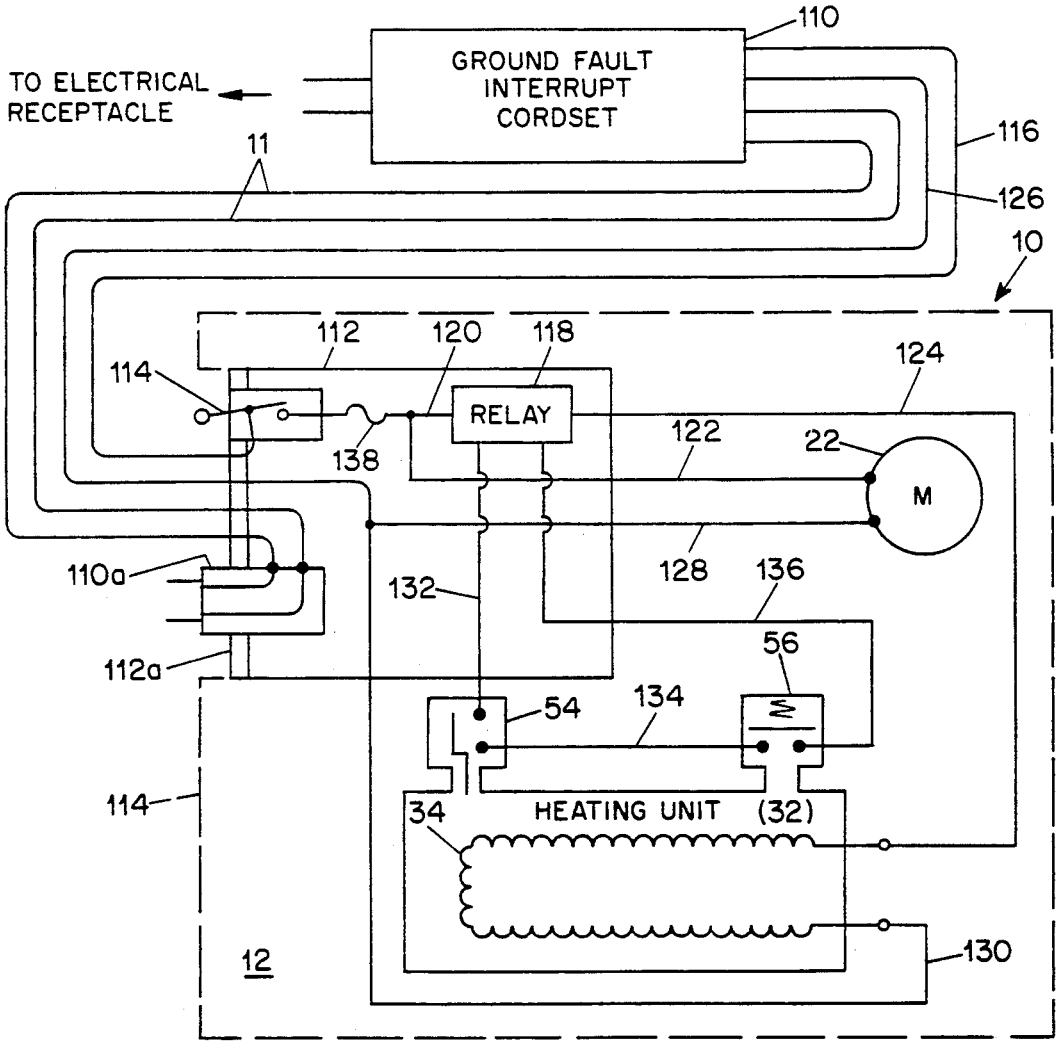
FIG. 5 is a schematic diagram of the electrical circuit of the heating apparatus.

The energized conductor 116 of the cordset 110 is connected through the switch 114 to a relay 118 by a conductor 120 and to the motor of the fan 22 by a conductor 122. The power side of the relay 118 is connected by a conductor 124 to the heating elements 32 (only one of which is shown in FIG. 5). Circuits from the motor and heating element are completed to the ground side conductor 126 of the cordset by conductors 128 and 130. The control side of the relay is connected in series with the thermostatic switch 54 and the pressure switch 56 associated with the heating unit 34 by conductors 132, 134 and 136. When the temperature of the gas in the heating unit 34 is less than a predetermined temperature, the thermostatic switch 54 is closed. Since the pressure of the gas is proportional to its temperature (Boyle's Law), the pressure-responsive switch 56 may be set to remain closed unless the temperature (and, therefore, the pressure) of the gas rises above a predetermined level. The two switches are, preferably but not necessarily, set to open at about the same temperature. The provision of the two switches is intended to provide a double-safety over-temperature cutoff, rather than thermostatic cycling control of the heating unit, which is designed to run full time. If the air intake or discharge should become obstructed or the fan fail, the two cutoff switches will open and shut off power to the heating unit. If one of the switches fails to open, the other almost certainly will—the odds of both switches failing to open is much greater than the odds of either one failing. The relay may be of a failsafe type that shuts off power if it fails. Also a fuse 138 is inserted either in the conductor 120 or upstream of the power switch 114. When power to the heating unit 34 is interrupted, the fan will remain on in order to cool the unit. For most uses, thermostatic control of the air delivered by the apparatus is unnecessary, but thermostatic control can be incorporated, such as by installing a thermostatic switch in the downstream end of the tube 26 and wiring it in series with the control side of the relay 118.

The heating apparatus can be designed to draw 1500 watts power at 110 volts, which gives it the capability of raising the temperature of about 30 gallons of water 20° F. in one hour. This is suitable for use of the apparatus with standard bathtubs, small whirlpool tubs and spas, and the raft described below. In larger tubs and spas, the apparatus will reduce the heat loss from the water and make it more pleasurable for a longer time without having to add hot water, thereby reducing the expense of using the tub or spa. Larger units powered by 220 volt power can, of course, be produced for use with large tubs and spas.

Figure 6:
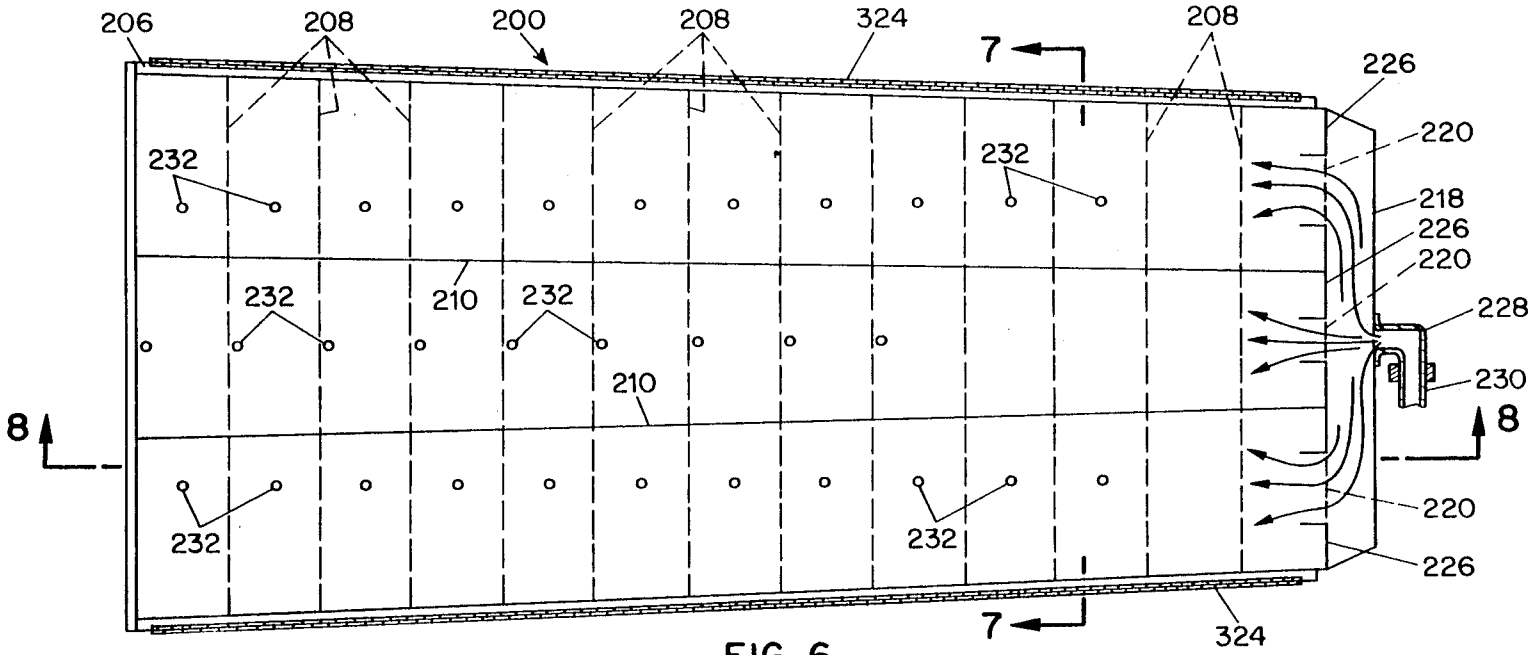
FIG. 6 is a top plan view of an embodiment of an air distribution mat according to the present invention.
Figure 7:
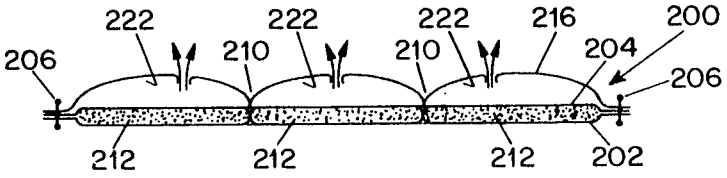
FIG. 7 is an end cross-sectional view of the mat of FIG. 6 taken along the line 7—7 of FIG. 6.
Figure 8:
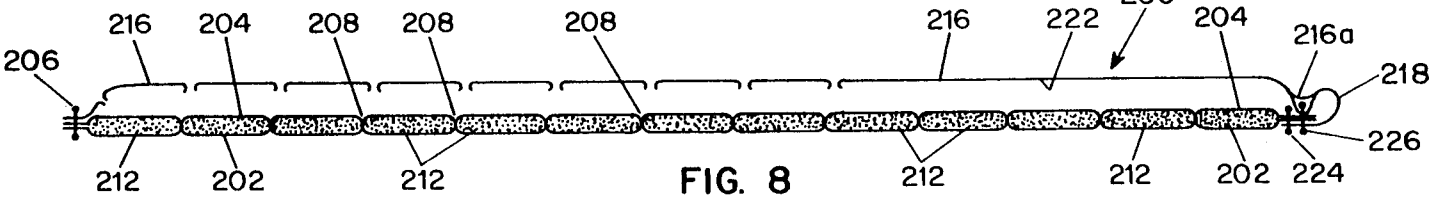
FIG. 8 is a side cross-sectional view of the mat taken along the line 8—8 of FIG. 6.

The air distribution mat 200 shown in FIGS. 6 to 8 is usable with the heating apparatus to provide a pleasurable, gentle bubbling agitation of water in a tub or spa without cooling the water. A bottom flexible sheet 202 and an intermediate flexible sheet 204 are stitched together along stitch lines 206 at their perimeters, along transverse stitch lines 208 and along lengthwise stitch lines 210 to form a multiplicity of compartments 212, each of which contains granules of a material having a density considerably greater than that of water, such as sand, silica, or a ceramic. The bottom sheet 202 is, preferably, a water permeable fabric so that water can enter and drain from the compartments 212. The intermediate sheet 204 should be substantially gas-impermeable, since it forms one wall of each of three air distribution chambers 222, and may be a plastic- or rubber-coated fabric. A top sheet 216 of a flexible, substantially gas-impermeable material, preferably a coated-fabric, is stitched along the lengthwise stitch lines 210 and along each side margin and the longer end margin of the mat to the sheets 202 and 204. The narrower end of the top sheet 216 is formed into a transverse tube 218 in a manner such as to leave openings 220 from the tube into each air distribution chamber 222 formed by the sheets 204 and 212. The end of the sheet 216 is stitched along a stitch-line 224 entirely across the mat to the sheets 202 and 204 and is turned back on itself and stitched along stitch lines 226 that are interrupted at each opening 220. When air is supplied to the tube 218, it will enlarge the openings 220 by making the top sheet 216 bulge upwardly, as shown at **216*a* to the right in FIG. 8, thereby allowing the hot air, which enters the tube through a coupling 228 affixed to the tube 218 and connected to a hose 230, to flow into each distribution chamber 222. The air is released into the water in which the mat is immersed through holes 232 formed by grommets affixed to the top sheet 216**. The grommet holes in the center chamber are staggered longitudinally relative to those in the two side chambers, so that the air bubbles will track along different lines of the body of a person using the mat.

The mat is placed in a tub with the narrower end resting on the tub bottom and the wider end lying along the end wall. The granule-filled chambers keep the mat from lifting up from the tub bottom and end wall, so the chambers can fill with air. The air pressure is not enough to inflate the chambers fully, like an air mattress, but they will partially fill as permitted by the contours of the person's body. The air holes are located so that they line up with parts of the body that do not reside in contact with the tub bottom and wall, such as the center of the back and the areas just inside the shoulder blades. While some grommet holes may be occluded by the user's body, most will not, and bubbles of warm air will stream out of the open holes and track along the user's body, giving a very relaxing and pleasurable sensation. In addition to keeping the mat immersed, the granule-filled bottom portion provides a degree of softness to the mat and provides a thermal-insulating characteristic.

In accordance with another aspect of the present invention, the heating apparatus and air distribution mat may be used with a raft, thereby allowing a user to float on a pool, pond or stream immersed in bubbling warm water. The air distribution mat can be placed in a conventional small raft, which is partially filled with water and allowed to warm up by bubbling hot air from the heating apparatus through the water for an hour or so. The granule-filled mat bottom thermally insulates the raft bottom from the pool water and keeps the mat immersed so that the hot air bubbles travel a maximum distance before being released to the atmosphere, thereby maximizing the transfer of heat to the water in the raft. When the water in the raft has been warmed, the user can climb aboard and enjoy the relaxing and pleasurable gentle massage of the warm air bubbles while afloat in a pool, pond or stream.

A specially designed raft 300 for use with the heating apparatus and a distribution mat is shown in FIGS. 9 to 14. It comprises interconnected inflatable portions made by joining two sheets of flexible air-impermeable material, preferably rubber- or plastic-coated fabrics, together to form compartments, to wit: a tubular peripheral collar 302 that is, in plan, roughly semi-circular at one end and roughly trapezoidal at the other end, the semi-circular end being quite wide relative to the trapezoidal end and having a larger air volume; a smaller rectangular pad 304 at the narrow end; a larger rectangular pad 306 near the longitudinal center; and arms 308 and 310 extending laterally in each direction from the longitudinal ends of the pad 306. Extending along most of the length of the center portion of the raft is a compartmented, granule-filled raft bottom 312 formed of two sheets of flexible material, preferably water-permeable fabrics, stitched along stitch lines 314, 316. Each of the three sections 318, 320, and 322 on either side of the raft bottom 312 contains a sheet of a closed-cell, moderately flexible polymeric foam. The foam sheets provide the characteristics of buoyancy, a degree of stiffness, and thermal insulation to the sections 318, 320 and 322, which are the sides of the raft 300. While the raft can be made of plastic films, such as PVC, joined by fusion, it is preferred to use rubber- or plastic-coated fabrics and sewing and bonding techniques, such as those used in rubber life rafts, because of their greater durability and longer life.

Figure 9:
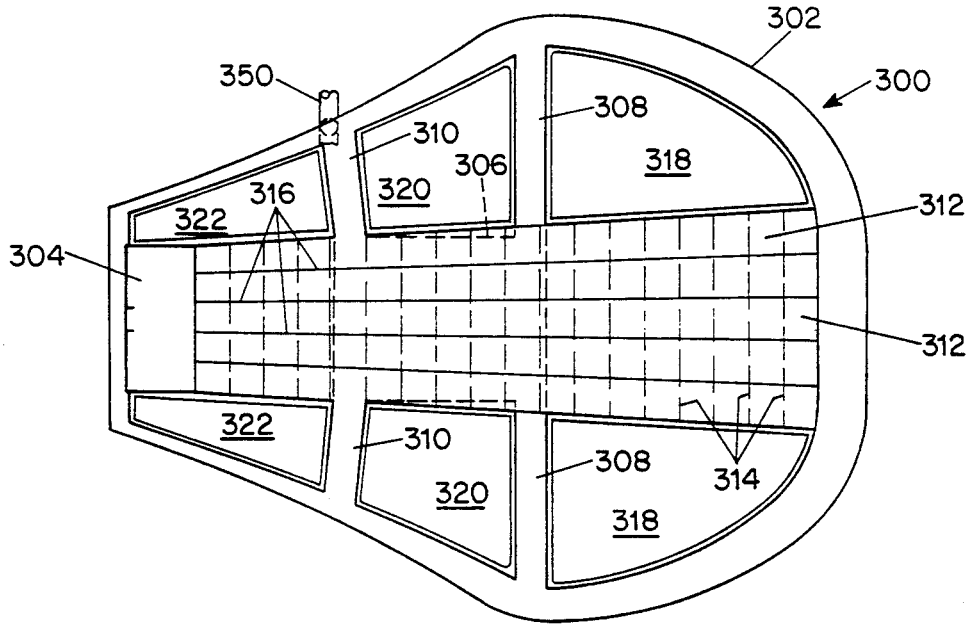
FIG. 9 is a top plan view of an embodiment of a raft according to the present invention shown in flattened condition.
Figure 10:
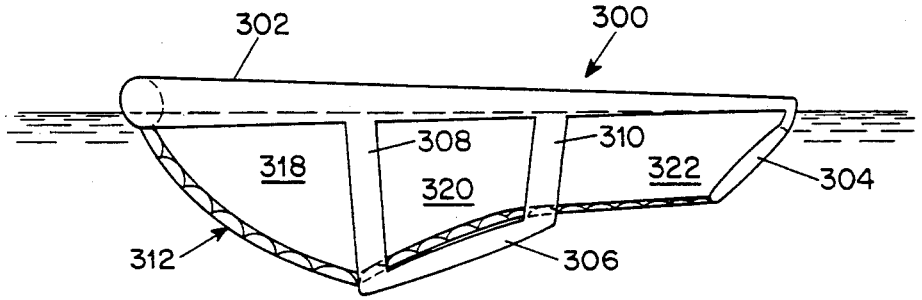
FIG. 10 is a side elevational view of the raft of FIG. 9.
Figure 11:
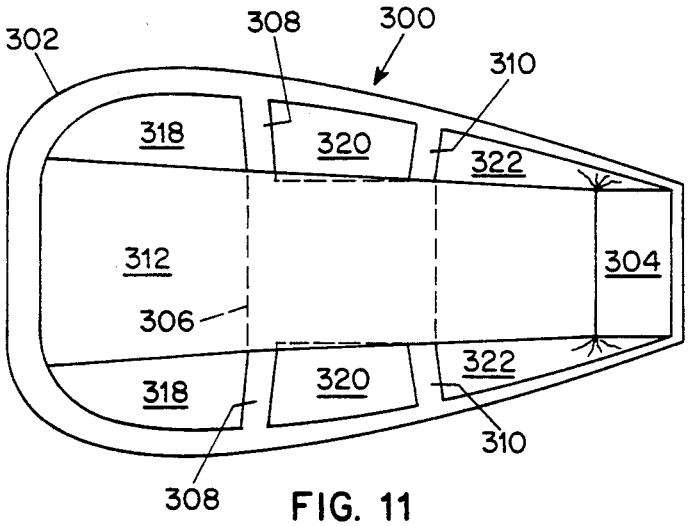
FIG. 11 is a top plan view of the raft shown in the configuration it assumes when afloat.
Figure 12:
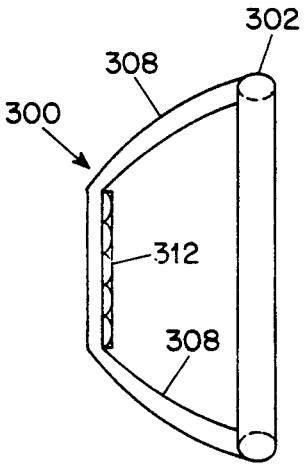
FIG. 12 is an end elevational view of the raft.
Figure 14:
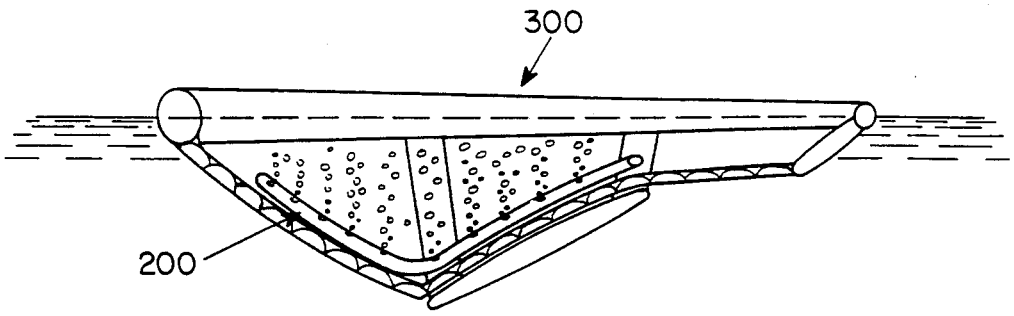
FIG. 14 is a side cross-sectional view of the raft and mat afloat and showing heated air bubbling up from the mat.
Figure 13:
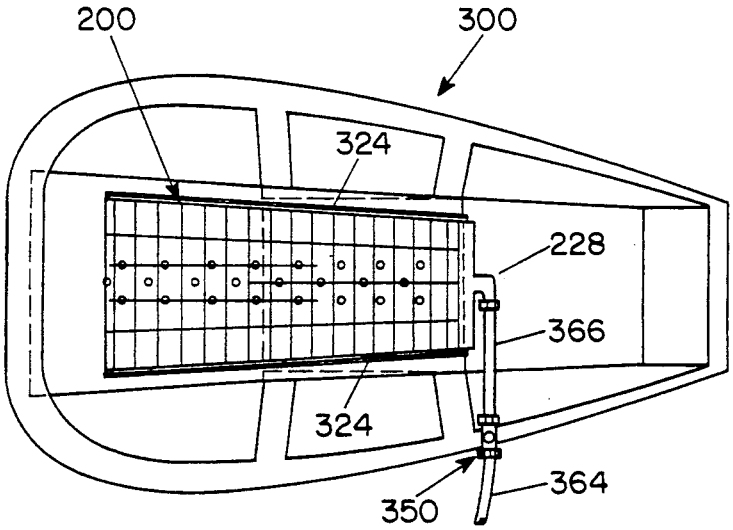
FIG. 13 is a top plan view of the raft and mat as assembled and afloat.
Figure 15:
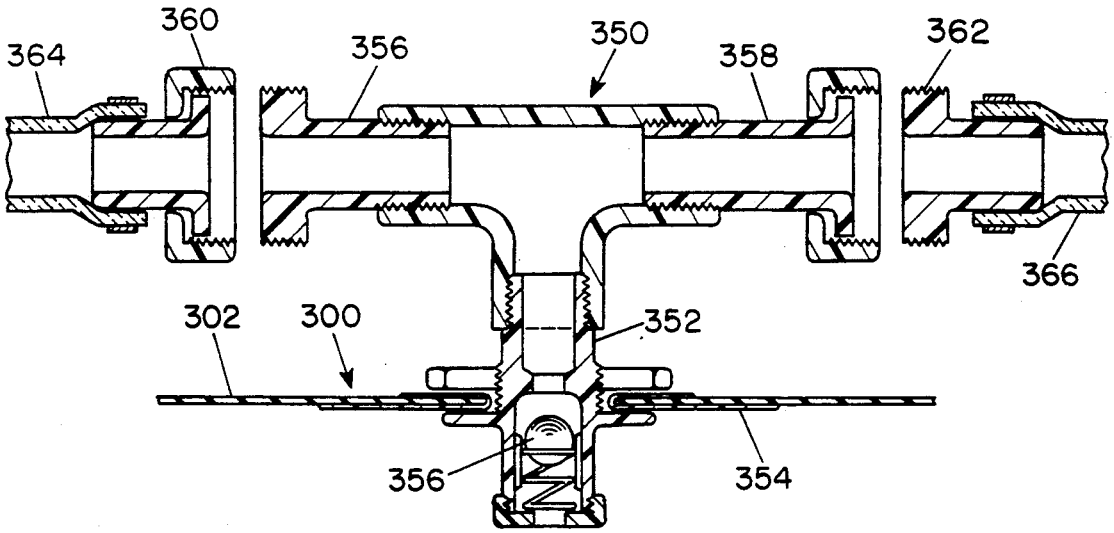
FIG. 15 is an exploded cross-sectional view of a fill valve for the raft and couplings to air-distribution hoses.

FIG. 9 shows the raft in its flattened condition as manufactured and as it is when out of the water and not inflated. FIGS. 10 to 13 show its configuration when inflated and in the water. The peripheral air chamber 302 provides the buoyancy to keep the raft afloat. The weight of the granule-filled bottom 312 overcomes the buoyancy of the foam-filled side sections 318, 320, and 322, the pad 306 and the arms 308 and 310 to keep the bottom immersed when the raft is filled with water.

The air distribution mat 200 is placed in the raft bottom and fixed in place, zippers 324 (FIG. 6), snaps or other fasteners being provided to hold it in place. The mat measures about 18″×36″ so that it extends from the thighs to the shoulders of the user. The user's head can rest on the head end of the peripheral chamber 302 of the raft and his or her feet on the pad 304. Before boarding the raft, the user can preheat the water in the raft by turning on the heating apparatus, which supplies heated air to the pad. The air bubbles up through the water and heats it. In an hour or two the water in the raft will be comfortably warm. The water in the raft is thermally insulated from the water in the pool, pond or stream, which aids in warming the water in the raft and keeping it warm by minimizing loss of heat from the water in the raft.

The raft can be inflated by the air supplied by the heating apparatus. A T-shaped air hose fitting 350 (see FIG. 14) is attached to the peripheral chamber 302 of the raft. The leg of the fitting 350 that is mounted to the raft wall (a reinforcing strip 354 being joined to the raft wall) has a one-way check valve 356 to trap inflation air in the raft air chambers. The branch arms 356 and 358 of the fitting mate with garden hose type couplings 360 and 362 on an air supply hose 364 leading from the heating apparatus and a hose 366 connected to the fitting 328 on the air distribution pad 200. The raft can also have an air-pump fitting (not shown) for inflating it using a hand or motor-powered air pump. A fitting with a cap (also not shown) is provided on the raft to release the air for deflation.

To prevent damage to the hoses, fittings, raft and heating apparatus and to prevent the heating apparatus from being pulled into the water, the raft should be tethered by a rope to a fixed object near the heating apparatus so that there will always be some slack in the hose 364 connecting the raft to the heating apparatus. For obvious reasons, the heating apparatus should also be suitably secured to a fixed object on land. Should a careless user not take these precautions, the ground fault interrupt will instantly disconnect the power from the heating apparatus at the electrical plug should the apparatus be pulled or knocked into the water.

The mat 200 and raft 300, being made of flexible materials, can be rolled up for storage. When the temperature of the pool or pond is comfortable, the raft can, of course, be used without the heating apparatus and mat. Similarly, the heating apparatus and mat can be used indoors in a bathroom for a whirlpool effect in the tub and space heating when the outdoor pool cannot be used.

Figure 16:
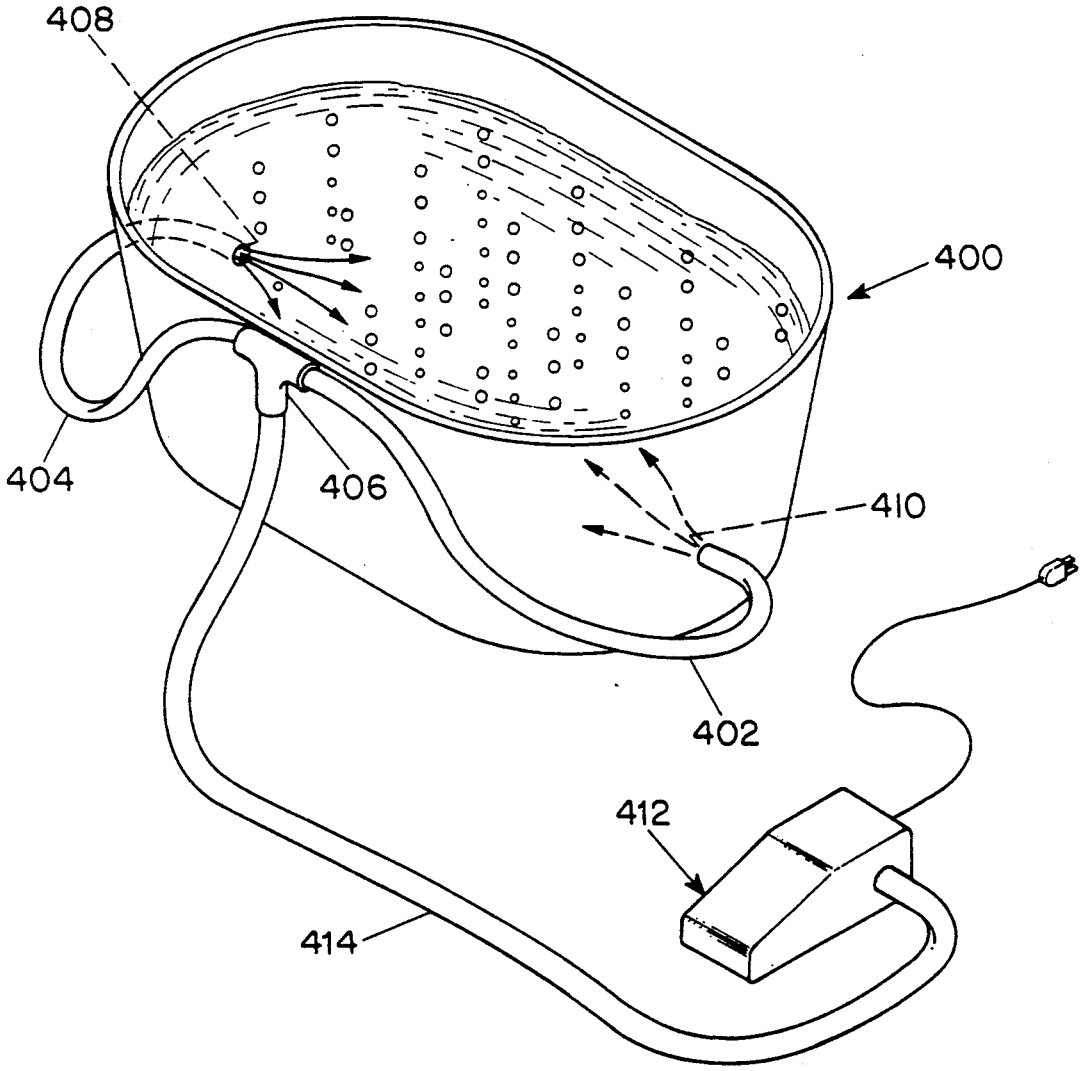
FIG. 16 is a pictorial view showing the apparatus connected by hoses to inlets to a tub.

FIG. 16 shows a relatively small, simple hot tub 400 having a capacity of, say, 60 gallons, a size suitable for two people. Hoses 402 and 404 lead from a T-coupling 406 suitably fastened to the wall of the tub above the water level to inlets 408 and 410 located near the bottom of the tub. The heating apparatus of FIGS. 1 to 5, designated by numeral 412, is connected by a hose 414 to the T-coupling. The tub can be made inexpensively in various ways, such as by molding from fiberglass or fabricating it from a framework, wall panel and plastic liner in the manner commonly used for above-ground swimming pools. The heating apparatus used with a tub of this capacity should use 220 V, 3000 watt power, which will enable the apparatus to raise the water temperature in the tub about 20° F. in an hour. The hot tub and heating apparatus of FIG. 16 can be sold for a few hundred dollars and operated for less than a dollar per use, amounts that are fractions of conventional hot tubs. Hot air blown into the tub by the heating apparatus 412 not only heats the water but produces a vigorous bubbling and agitation of the water, which is pleasurable and has therapeutic value in relaxing tense muscles. The blower for the heating apparatus may have sufficient power to induce strong whirling currents in the water for a whirlpool bath effect. To this end, the two inlets 408 and 410 are of a size such as to inject high velocity jets of hot air into the tub. Similarly, the provision of two inlets, as compared to a greater number, is intended to enhance the degree of agitation of the water. The intensity of the agitation can be reduced, if desired, by introducing the hot air through larger-sized inlets or a greater number of inlets.

We claim:

1. Heating apparatus comprising a closed vessel having thermally conducting walls and containing a gas; an electrical heating element within the vessel; means adapted to be connected to a source of electrical current for forming an electrical circuit with the heating element; pressure-responsive electrical switch means communicating with the gas in the vessel and connected in the heating element circuit such as to open the circuit in response to a predetermined pressure of the gas in the vessel; temperature-responsive electrical switch means for sensing the temperature of the gas in the vessel and connected in the heating element circuit such as to open the circuit in response to a predetermined temperature of the gas in the vessel; a duct surrounding the vessel and defining with the vessel walls an air flow passage; and blower means for causing ambient air to flow through the air flow passage such as to be heated by the vessel walls.

2. Apparatus according to claim 1 and further comprising pressure relief valve means connected to the vessel for releasing the gas from the vessel in response to a predetermined pressure thereof.

3. Apparatus according to claim 1 and further comprising a housing having oppositely located side walls, means defining a hot air outlet in one of the side walls, the duct being in communication with the outlet, and a hose coupling mounted in the outlet and adapted to be connected to a hose, whereby heated air may be conducted to a location remote from the duct.

4. Apparatus according to claim 3 and further comprising ground fault interrupt circuit means having sensing electrodes located on the housing for opening the electrical circuit in the event that water forms a conductive path between the sensing electrodes.

5. Apparatus according to claim 3 wherein the housing has top, bottom, front and rear walls, all of which extend between the side walls, the duct extends between the side walls, is located adjacent the rear wall, and is supported in the housing in spaced-apart relation to the top and bottom walls, and the blower is located within the housing on the opposite side of the duct from the rear wall and has its intake within the housing, and the rear wall has inlet openings for admitting air to the housing, whereby ambient air is inducted into the housing through the inlet openings, flows over the outer surface of the duct, and extracts heat from the duct, thereby keeping the housing walls relatively cool and preheating the air.

6. Apparatus according to claim 1 wherein the vessel has a circular cylindrical peripheral wall, the peripheral wall has a multiplicity of external ribs projecting radially and extending axially, the duct is a circular cylindrical tube, and the extremities of the ribs engage the inner surface of the duct, whereby the ribs both support the vessel in the duct and transfer heat to the air flowing through the passage.

7. Apparatus according to claim 1 and further comprising a housing receiving the vessel, duct and blower, and wherein the duct communicates at its hot air discharge end with two hot air outlets on the housing, one of which outlets includes a hose coupling adapted to receive a hose for conducting hot air to a location remote from the housing, and the other of which leads to a distributor pipe adapted to discharge hot air to the environment of the housing.

8. Apparatus according to claim 7 wherein the distributor pipe is fixed to the housing and has at least one outlet slot opening in a direction away from the interior of the housing, and further comprising a discharge control tube received telescopically over the distributor pipe for movement relative thereto, the control tube having at least one outlet passage located for registration with the outlet slot of the distributor pipe in at least one first position of the control tube relative to the distributor pipe and for non-registration with the distributor pipe in a second position of the control tube relative to the distributor pipe.

9. Apparatus according to claim 8 wherein the control tube is rotatably mounted on the distributor tube and the first and second positions of the outlet passage are circumferentially spaced apart relative to the distributor pipe.

10. Apparatus according to claim 8 and further comprising flapper valve means for selectively opening and closing said one outlet.

11. Apparatus according to claim 10 and further comprising linkage means between said flapper valve means and the control tube for automatically closing said one outlet when the control tube is in its first position and opening said one outlet when the control tube is in its second position.

12. Apparatus according to claim 9 wherein a handle is attached to the control tube for the dual purposes of rotating the control tube and transporting the housing and its contents.

13. Apparatus according to claim 9 wherein the circumferential extent of the outlet slot in the distributor pipe is greater than that of the outlet slot in the control pipe, whereby the direction of the hot air flow discharged from the outlet slot can be adjusted in accordance with the rotational position of the control tube.

14. Apparatus according to claim 1 and further comprising a housing containing the duct, vessel and blower and having a hot air outlet communicating with the passage downstream of the blower, a hot air distribution pad adapted to be submerged in a body of water contained in a tub, spa, pool or the like and to be sat or lain upon by a person, and a hose connecting the hot air outlet with the pad.

15. Apparatus according to claim 14 wherein the pad includes at least two elongated chambers defined by air-impermeable flexible webs, each chamber communicating with the hose and having a multiplicity of outlet orifices for releasing hot air.

16. Apparatus according to claim 14 wherein the pad is weighted to an extent that it remains submerged when hot air is conducted into it.

17. Apparatus according to claim 16 wherein the pad includes a pair of flexible webs joined to each other such as to form a multiplicity of compartments and wherein each compartment contains a quantity of a granular material having a density substantially greater than that of water.

18. Apparatus according to claim 14 wherein the pad includes three elongated air distribution chambers disposed laterally adjacent each other and having lengths such as to extend from the lower thighs to the shoulders of a person, the outer two chambers being divergent with respect to each other from a thigh end to a shoulder end and each chamber having a multiplicity of longitudinally spaced-apart air outlet orifices.

19. Apparatus according to claim 18 wherein the outlet orifices of the two outer chambers are staggered lengthwise relative to the outlet orifices of the center chamber.

20. Apparatus according to claim 19 wherein the outlet chambers are defined by first and second webs of air-impermeable flexible material.

21. Apparatus according to claim 20 wherein the material of the first and second webs is a coated fabric.

22 Apparatus according to claim 14 wherein the pad includes first and second flexible webs joined to each other such as to define a multiplicity of compartments, a quantity of finely divided material having a density substantially greater than water contained in each compartment, and a third web of air-impermeable flexible material joined to the second web such as to define at least two elongated air distribution chambers, the third web having a multiplicity of longitudinally spaced apart air outlet orifices.

23. Apparatus according to claim 14 and further comprising a floatable raft receiving the hot air distribution pad.

24. Apparatus according to claim 23 wherein the raft includes a peripheral air-inflatable floatation chamber formed by air-impermeable flexible members.

25. Apparatus according to claim 23 wherein the raft includes a pair of air-impermeable flexible webs joined to each other to form an air-inflatable floatation chamber along their perimeters and a raft bottom upon which the pad rests and by which it is supported.

26. Apparatus according to claim 24 wherein the floatation chamber has an air inlet in communication with the hose, whereby the floatation chamber is inflated by the hot air conducted through the hose from the passage.

27. Apparatus according to claim 25 wherein the raft bottom includes compartments, each of which contains a polymeric foam sheet that provides bouyancy to the raft such as to keep it and the pad afloat, even when the floatation chamber is not inflated.

28. Apparatus according to claim 27 wherein the raft bottom includes a bottom air-inflatable floatation chamber positioned to underlie a portion of the pad.

29. Apparatus according to claim 28 wherein the raft bottom includes lateral air-inflatable floatation chambers extending generally laterally between the bottom chamber and the peripheral chamber.

30. Apparatus according to claim 25 wherein the pad is detachably fastened to the raft bottom.

31. Apparatus according to claim 1 and further comprising an air outlet from the air flow passage, a hose connected to the air outlet, a tub containing water and having at least one air inlet connected to the hose such that a jet of heated air is injected into the tub to produce vigorous bubbling and agitation of the water.

* * * * *